US009966021B2

(12) United States Patent
Kim et al.

(10) Patent No.: US 9,966,021 B2
(45) Date of Patent: May 8, 2018

(54) DISPLAY APPARATUS HAVING A DATA DRIVER FOR GENERATING A DATA KICKBACK SIGNAL AND A METHOD OF DRIVING THE SAME

(71) Applicant: SAMSUNG DISPLAY CO., LTD., Yongin-si, Gyeonggi-do (KR)

(72) Inventors: Woonyong Kim, Hwaseong-si (KR); Kyeongseok Lee, Asan-si (KR); Jaehyun Koh, Asan-si (KR); Sung-Jun Kim, Cheonan-si (KR); Jeong-Hyun Kim, Cheonan-si (KR); Sungsoo Choi, Anyang-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 49 days.

(21) Appl. No.: 15/179,080

(22) Filed: Jun. 10, 2016

(65) Prior Publication Data

US 2017/0148397 A1 May 25, 2017

(30) Foreign Application Priority Data

Nov. 20, 2015 (KR) ..... 10-2015-0163423

(51) Int. Cl.
*G09G 5/10* (2006.01)
*G09G 3/36* (2006.01)

(52) U.S. Cl.
CPC ..... *G09G 3/3607* (2013.01); *G09G 3/3614* (2013.01); *G09G 3/3685* (2013.01); *G09G 2310/08* (2013.01); *G09G 2320/0223* (2013.01); *G09G 2320/0242* (2013.01)

(58) Field of Classification Search
CPC ..... G09G 3/3607
USPC ..... 345/690
See application file for complete search history.

(56) References Cited

U.S. PATENT DOCUMENTS

2008/0224983 A1* 9/2008 Lee ..... G09G 3/3648 345/98
2012/0274624 A1* 11/2012 Lee ..... G09G 3/3648 345/213
2013/0293526 A1* 11/2013 Igawa ..... G09G 3/3696 345/212

FOREIGN PATENT DOCUMENTS

KR 1020090047691 5/2009

* cited by examiner

*Primary Examiner* — Long D Pham
(74) *Attorney, Agent, or Firm* — F. Chau & Associates, LLC

(57) ABSTRACT

A display apparatus includes a display panel, a timing controller and a data driver. The display panel includes a data line and first and second pixels connected to the data line. The timing controller generates a data signal and a data kickback control signal in response to input image data. The data driver generates first and second data voltages in response to the data signal, generates a data kickback signal in response to the data kickback control signal, processes the data voltages and the data kickback signal, and outputs the first data voltage to the data line during a first duration, the second data voltage to the data line during a second duration, and a first kickback data voltage to the data line during a first data kickback duration. The first data kickback duration is between the first and second durations.

20 Claims, 6 Drawing Sheets

DISPLAY APPARATUS HAVING A DATA DRIVER FOR GENERATING A DATA KICKBACK SIGNAL AND A METHOD OF DRIVING THE SAME

CROSS-REFERENCE TO RELATED APPLICATION

This application claims priority under 35 U.S.C. § 119 to Korean Patent Application No. 10-2015-0163423, filed on Nov. 20, 2015 in the Korean Intellectual Property Office (KIPO), the disclosure of which is incorporated by reference herein in its entirety.

TECHNICAL FIELD

Exemplary embodiments of the present inventive concept relate generally to display devices, and more particularly to display apparatuses and methods of driving the display apparatuses.

DESCRIPTION OF THE RELATED ART

Generally, a liquid crystal display ("LCD") apparatus includes a first substrate including a pixel electrode, a second substrate including a common electrode and a liquid crystal layer disposed between the first substrate and the second substrate. An electric field is generated by voltages applied to the pixel electrode and the common electrode. By adjusting an intensity of the electric field, a transmittance of light passing through the liquid crystal layer may be adjusted so that an image may be displayed.

The LCD apparatus includes a display panel and a panel driver. The display panel includes a plurality of gate lines, a plurality of data lines and a plurality of pixels connected to the gate lines and the data lines. The panel driver includes a gate driver for providing gate signals to the gate lines and a data driver for providing data voltages to the data lines.

Pixels of the display panel have different charging rates from each other because of a resistive capacitive (RC) delay of the data lines. As a consequence, areas of the display panel may unintentionally display a different color from each other.

SUMMARY

A display apparatus according to an exemplary embodiment of the present inventive concept includes a display panel, a timing controller and a data driver. The display panel comprises a data line and first and second pixels connected to the data line. The timing controller is configured to generate a data signal and a data kickback control signal in response to input image data. The data driver is configured to generate first and second data voltages in response to the data signal, generate a data kickback signal in response to the data kickback control signal, process the first and second data voltages and the data kickback signal, and output the first data voltage to the data line during a first duration, the second data voltage to the data line during a second duration, and a first kickback data voltage to the data line during a first data kickback duration. The first data voltage corresponds to the first pixel. The second data voltage corresponds to the second pixel. The first kickback data voltage has a first data kickback level. The first data kickback duration is between the first and second durations.

In an exemplary embodiment of the present inventive concept, the data kickback signal may have the first data kickback level during the first data kickback duration.

In an exemplary embodiment of the present inventive concept, the data kickback control signal may include first and second data kickback control signals. The first data kickback level may be determined in response to the first data kickback control signal. A width of the first data kickback duration may be determined in response to the second data kickback control signal.

In an exemplary embodiment of the present inventive concept, the display apparatus may further include a gamma reference voltage generator configured to generate gamma reference voltages corresponding to the data signal. The data driver may be configured to select one of the gamma reference voltages in response to the first data kickback control signal to determine the first data kickback level.

In an exemplary embodiment of the present inventive concept, the data driver may include a multiplexer configured to select one of the gamma reference voltages in response to the first data kickback control signal.

In an exemplary embodiment of the present inventive concept, the data driver may be configured to process the first and second data voltages and the data kickback signal by using a switching circuit.

In an exemplary embodiment of the present inventive concept, the display panel may be divided into a plurality of areas. The first data kickback level and a width of the first data kickback duration may be determined according to an area of the display panel on which the first and second pixels are disposed.

In an exemplary embodiment of the present inventive concept, as an area of the display panel on which the first and second pixels are disposed gets farther away from the data driver, the first data kickback level may decrease.

In an exemplary embodiment of the present inventive concept, as an area of the display panel on which the first and second pixels are disposed gets farther away from the data driver, the width of the first data kickback duration may increase.

In an exemplary embodiment of the present inventive concept, the first pixel may be configured to display a first color. The second pixel may be configured to display a second color different from the first color.

In an exemplary embodiment of the present inventive concept, the first and second pixels may be included in a unit pixel.

In an exemplary embodiment of the present inventive concept, the first data kickback level may be different from a level of the first data voltage and a level of the second data voltage.

In an exemplary embodiment of the present inventive concept, a polarity of the first kickback data voltage may be substantially the same as a polarity of the first data voltage and a polarity of the second data voltage.

According to an exemplary embodiment of the present inventive concept, a method of driving a display apparatus comprising a display panel, which comprises a data line and first and second pixels connected to the data line, includes generating a data signal and a data kickback control signal in response to input image data, generating first and second data voltages in response to the data signal, the first data voltage corresponding to the first pixel, the second data voltage corresponding to the second pixel, generating a data kickback signal in response to the data kickback control signal, processing the first and second data voltages and the data kickback signal, outputting the first data voltage to the data line during a first duration, outputting the second data voltage to the data line during a second duration, and outputting a first kickback data voltage to the data line during a first data kickback duration, the first kickback data voltage having a first data kickback level, the first data kickback duration being between the first and second durations.

In an exemplary embodiment of the present inventive concept, the data kickback signal may have the first data kickback level during the first data kickback duration.

In an exemplary embodiment of the present inventive concept, the method may further include determining the first data kickback level in response to the data kickback control signal, and determining a width of the first data kickback duration in response to the data kickback control signal.

In an exemplary embodiment of the present inventive concept, determining the first data kickback level may include selecting one of gamma reference voltages in response to the data kickback control signal.

In an exemplary embodiment of the present inventive concept, processing the first and second data voltages and the data kickback signal may include combining the first and second data voltages and the data kickback signal by using a switching circuit.

According to an exemplary embodiment of the present inventive concept, a data driver comprises: a data voltage generating circuit configured to generate first and second data voltages in response to a data signal; a data kickback circuit configured to generate a data kickback signal in response to a data kickback control signal; and a switching circuit configured to generate a kickback data voltage based on the first and second data voltages and the data kickback signal, wherein the kickback data voltage is output between the first and second data voltages.

In an exemplary embodiment of the present inventive concept, the first data voltage may correspond to a first pixel of a display panel and the second data voltage may correspond to a second pixel of the display panel, and a level and a duration of the kickback data voltage may depend on the location of the first and second pixels in the display panel.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EMBODIMENTS

Hereinafter, exemplary embodiments of the present inventive concept will be explained in detail with reference to the accompanying drawings.

Figure 1:
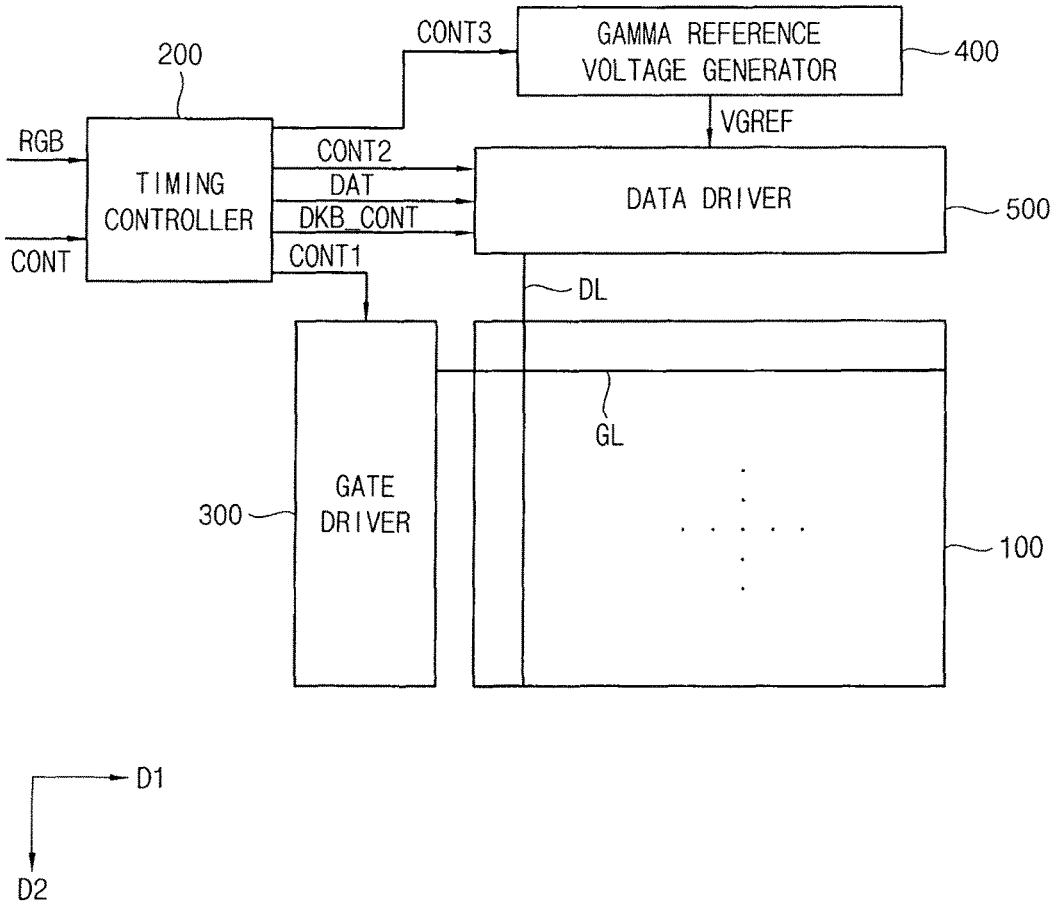
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400 and a data driver 500. The elements of the display panel 100 and the panel driv er may each be composed of circuits.

The display panel 100 includes a display region for displaying an image and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

In an exemplary embodiment of the present inventive concept, each of the pixels may include a switching element, a liquid crystal capacitor and a storage capacitor. The liquid crystal capacitor and the storage capacitor may be electrically connected to the switching element. The pixels may be arranged in a matrix configuration.

The display panel 100 will be explained in detail with reference to FIGS. 2 and 3.

The timing controller 200 receives input image data RGB and an input control signal CONT from an external device. The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, a data kickback control signal DKB_CONT and a data signal DAT based on the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500.

The timing controller 200 generates the data kickback control signal DKB_CONT for controlling operations of the data driver 500 based on the input image data RGB, and outputs the data kickback control signal DKB_CONT to the data driver 500.

The timing controller 200 generates the third control signal CONT3 for controlling operations of the gamma reference voltage generator 400 based on the input control signal CONT, and outputs the third control signal CONT3 to the gamma reference voltage generator 400.

The gate driver 300 generates gate signals for driving the gate lines GL in response to the first control signal CONT1 received from the timing controller 200. The gate driver 300 sequentially outputs the gate signals to the gate lines GL.

In an exemplary embodiment of the present inventive concept, the gate driver 300 may be directly mounted on the display panel 100, or may be connected to the display panel 100 as a tape carrier package (TCP) type. In addition, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In an exemplary embodiment of the present inventive concept, the gamma reference voltage generator 400 may be disposed in the timing controller 200, or may be disposed in the data driver 500.

The data driver 500 receives the second control signal CONT2, the data signal DAT and the data kickback control signal DKB_CONT from the timing controller 200, and receives the gamma reference voltage VGREF from the gamma reference voltage generator 400. The data driver 500 converts the data signal DAT to data voltages having analog levels based on the gamma reference voltage VGREF. The data driver 500 generates a data kickback signal based on the data kickback control signal DKB_CONT. The data driver 500 processes the data voltages and the data kickback signal, and generates kickback data voltages. The data driver 500 outputs the data voltages and the kickback data voltages to the data lines DL.

In an exemplary embodiment of the present inventive concept, the data driver 500 may be directly mounted on the display panel 100, or may be connected to the display panel 100 as a TCP type. In addition, the data driver 500 may be integrated on the peripheral region of the display panel 100.

The data driver 500 will be explained in detail with reference to FIGS. 4 through 6.

Figure 2:
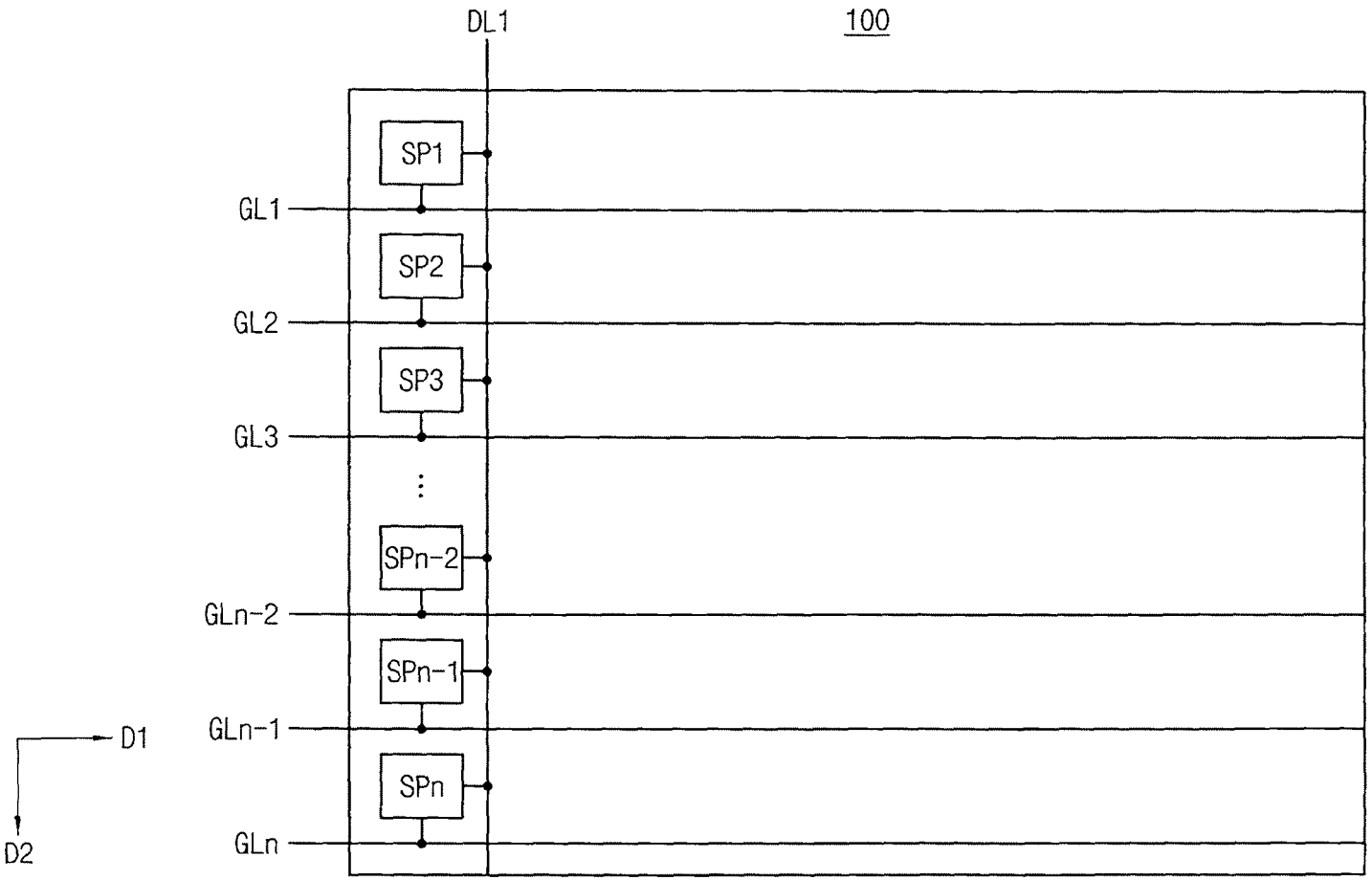
FIG. 2 is a diagram illustrating a display panel included in a display apparatus according to an exemplary embodiment of the present inventive concept.

FIG. 2 is a diagram illustrating a display panel included in a display apparatus according to an exemplary embodiment of the present inventive concept.

Referring to FIGS. 1 and 2, the display panel 100 may include first through n-th gate lines GL1~GLn extending in the first direction D1. The display panel 100 includes a first data line DL1 extending in the second direction D2.

The display panel 100 may include first through n-th pixels SP1~SPn electrically connected to the first through n-th gate lines GL1~GLn and the first data line DL1. For example, the display panel 100 may include the first pixel SP1 electrically connected to the first gate line GL1 and the first data line DL1. The display panel 100 may include the second pixel SP2 electrically connected to the second gate line GL2 and the first data line DL1. The display panel 100 may include the third pixel SP3 electrically connected to the third gate line GL3 and the first data line DL1. The display panel 100 may include the (n−2)-th pixel SPn−2 electrically connected to the (n−2)-th gate line GLn−2 and the first data line DL1. The display panel 100 may include the (n−1)-th pixel SPn−1 electrically connected to the (n−1)-th gate line GLn−1 and the first data line DL1. The display panel 100 may include the n-th pixel SPn electrically connected to the n-th gate line GLn and the first data line DL1.

The first pixel SP1 and the (n−2)-th pixel SPn−2 may be subpixels for displaying a first color. The second pixel SP2 and the (n−1)-th pixel SPn−1 may be subpixels for displaying a second color different from the first color. The third pixel SP3 and the n-th pixel SPn may be subpixels for displaying a third color different from the first and second colors. The first through third pixels SP1~SP3 may compose a unit pixel. The (n−2)-th through n-th pixels SPn−2~SPn may compose a unit pixel.

Figure 3:
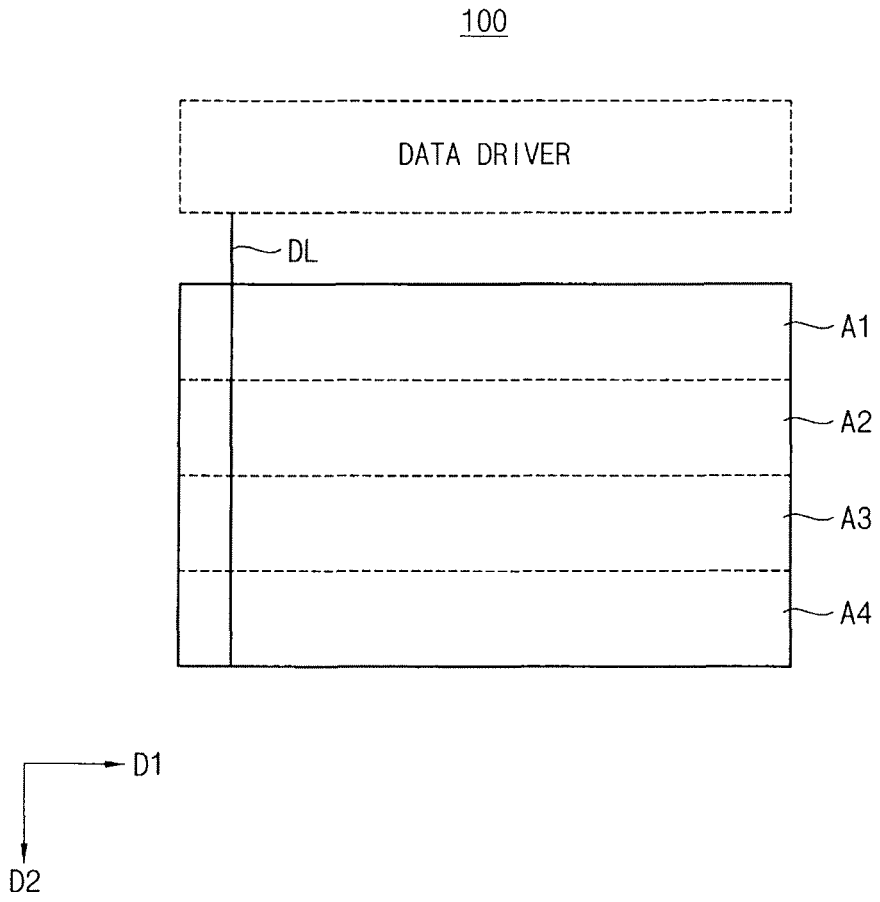
FIG. 3 is a diagram illustrating areas of a display panel included in a display apparatus according to an exemplary embodiment of the present inventive concept.

FIG. 3 is a diagram illustrating areas of a display panel included in a display apparatus according to an exemplary embodiment of the present inventive concept.

Referring to FIGS. 1 through 3, the display panel 100 may be divided into a plurality of areas. The areas of the display panel 100 may be divided according to their distance from the data driver 500. For example, the display panel 100 may be divided into first through fourth areas A1, A2, A3 and A4. The display panel 100 may be divided into the first through fourth areas A1~A4 according to their distances from the data driver 500. For example, the first area A1 may correspond to a portion of the display panel 100 closest to the data driver 500, and the fourth area A4 may correspond to a portion of the display panel 100 farthest from the data driver 500.

The first through third pixels SP1~SP3 may be disposed on the first area A1. The (n−2)-th through n-th pixels SPn−2~SPn may be disposed on the fourth area A4.

Figure 4:
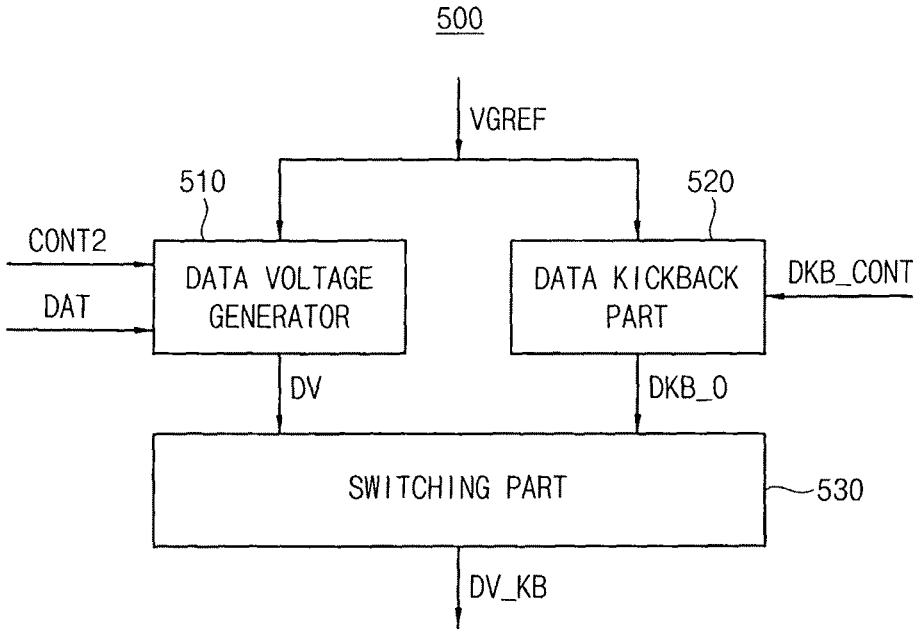
FIG. 4 is a block diagram illustrating a data driver included in a display apparatus according to an exemplary embodiment of the present inventive concept.

FIG. 4 is a block diagram illustrating a data driver included in a display apparatus according to an exemplary embodiment of the present inventive concept.

Referring to FIGS. 1 through 4, the data driver 500 includes a data voltage generator 510, a data kickback part 520 and a switching part 530.

The data voltage generator 510 converts the data signal DAT to data voltages DV based on the gamma reference voltage VGREF. For example, the data voltage generator 510 may generate a first data voltage corresponding to the first pixel SP1. The data voltage generator 510 may generate a second data voltage corresponding to the second pixel SP2. The data voltage generator 510 may generate a third data voltage corresponding to the third pixel SP3. The data voltage generator 510 may generate an (n−2)-th data voltage corresponding to the (n−2)-th pixel SPn−2. The data voltage generator 510 may generate an (n−1)-th data voltage corresponding to the (n−1)-th pixel SPn−1. The data voltage generator 510 may generate an n-th data voltage corresponding to the n-th pixel SPn.

The data kickback part 520 generates the data kickback signal DKB_O based on the data kickback control signal DKB_CONT.

The data kickback part 520 will be explained in detail with reference to FIG. 5.

The switching part 530 processes the data voltages DV and the data kickback signal DKB_O, and generates a kickback data voltage DV_KB. The switching part 530 may include a switching element. The switching part 530 may combine the data voltages DV and the data kickback signal DKB_O by switching operations of the switching element. The switching part 530 outputs the kickback data voltage DV_KB to the data lines DL.

The switching part 530 will be explained in detail with reference to FIG. 6.

The data driver 500 will be explained in detail with reference to FIG. 7.

Figure 5:
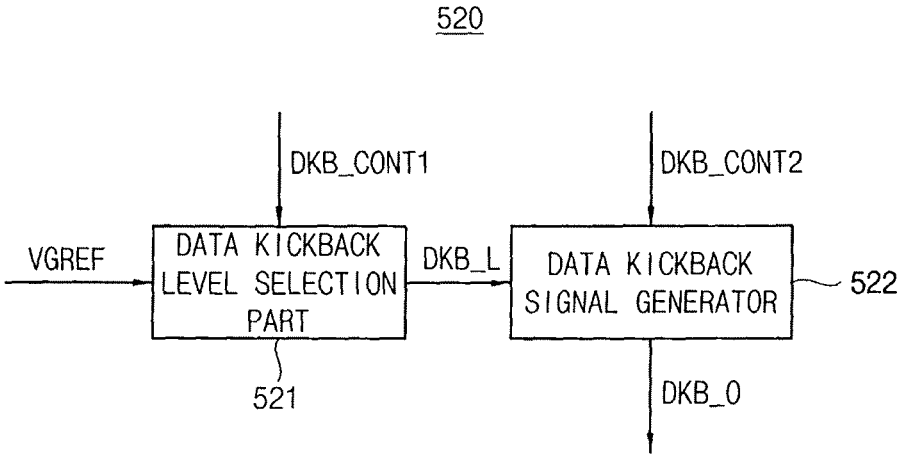
FIG. 5 is a block diagram illustrating a data kickback part included in a display apparatus according to an exemplary embodiment of the present inventive concept.

FIG. 5 is a block diagram illustrating a data kickback part included in a display apparatus according to an exemplary embodiment of the present inventive concept.

Referring to FIGS. 1 through 5, the data kickback part 520 may include a data kickback level selection part 521 and a data kickback signal generator 522.

The data kickback control signal DKB_CONT may include a first data kickback control signal DKB_CONT1 and a second data kickback control signal DKB_CONT2. A data kickback level DKB_L is determined based on the first data kickback control signal DKB_CONT1. A width of a data kickback duration is determined based on the second data kickback control signal DKB_CONT2.

The data kickback level selection part 521 may determine the data kickback level DKB_L based on the first data kickback control signal DKB_CONT1. For example, the data kickback level selection part 521 may select one of the gamma reference voltages VGREF based on the first data kickback control signal DKB_CONT1 to determine the data kickback level DKB_L.

The data kickback level selection part 521 will be explained in detail with reference to FIG. 6.

The data kickback signal generator 522 generates the data kickback signal DKB_O based on the data kickback level DKB_L and the second data kickback control signal DKB_CONT2. The data kickback signal DKB_O has the data kickback level DKB_L during the data kickback duration.

Figure 6:
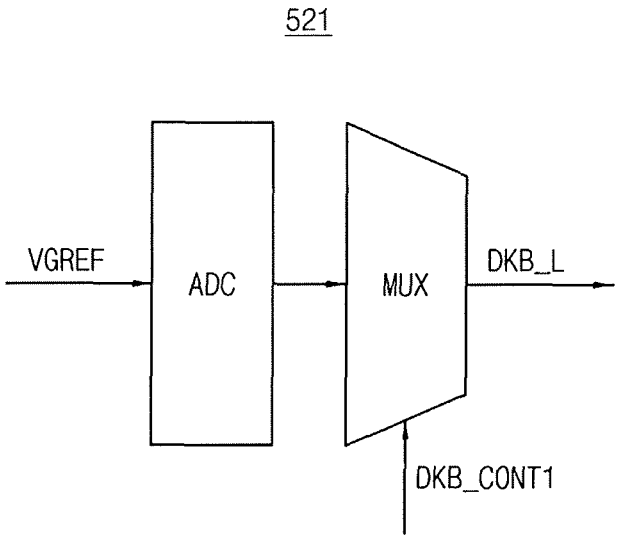
FIG. 6 is a block diagram illustrating a data kickback level selection part included in a display apparatus according to an exemplary embodiment of the present inventive concept.

FIG. 6 is a block diagram illustrating a data kickback level selection part included in a display apparatus according to an exemplary embodiment of the present inventive concept.

Referring to FIGS. 1 through 6, the data kickback level selection part 521 may include an analog-to-digital converter ADC and a multiplexer MUX.

The analog-to-digital converter ADC may convert the gamma reference voltages VGREF to digital values.

The multiplexer MUX may select one of the gamma reference voltages VGREF converted to the digital values based on the first data kickback control signal DKB_CONT1.

Figure 7:
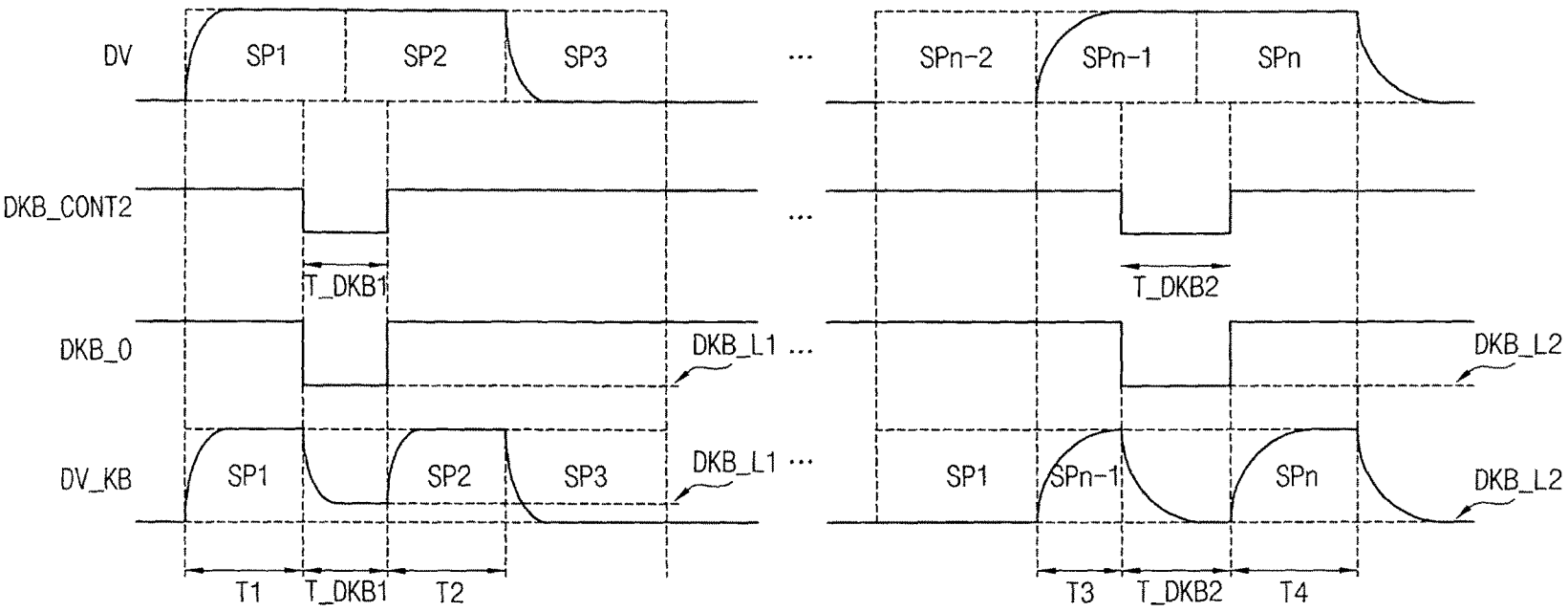
FIG. 7 is a timing diagram illustrating signals generated in a display apparatus according to an exemplary embodiment of the present inventive concept.

FIG. 7 is a timing diagram illustrating signals generated in a display apparatus according to an exemplary embodiment of the present inventive concept.

Referring to FIGS. 1 through 7, the data voltage generator 510 generates the data voltages DV based on the data signal DAT. For example, the data voltage generator 510 may generate first, second and third data voltages. The first data voltage corresponds to the first pixel SP1. The second data voltage corresponds to the second pixel SP2. The third data voltage corresponds to the third pixel SP3. The first and second data voltages may correspond to a maximum grayscale, and the third data voltage may correspond to a minimum grayscale. In this case, the first through third data voltages may be for displaying a yellow color, if the first pixel SP1 is a subpixel for displaying a red color and the second pixel SP2 is a subpixel for displaying a green color.

The data kickback signal generator 522 generates the data kickback signal DKB_O based on the second data kickback control signal DKB_CONT2. For example, the data kickback signal generator 522 may generate a first data kickback signal having a first data kickback level DKB_L1 during a first data kickback duration T_DKB1. The first data kickback level DKB_L1 may be different from levels of the first and second data voltages. For example, the first data kickback level DKB_L1 may be lower than the levels of the first and second data voltages. A polarity of the first data kickback signal may be substantially the same as polarities of the first and second data voltages.

The switching part 530 processes the data voltages DV and the data kickback signal DKB_O, and generates the kickback data voltage DV_KB. The kickback data voltage DV_KB has the data kickback level DKB_L during the data kickback duration T_DKB. For example, the switching part 530 may combine the first and second data voltages and the first data kickback signal, and may generate a first kickback data voltage. The first kickback data voltage may have the first data kickback level DKB_L1 during the first data kickback duration T_DKB1.

The switching part 530 outputs the data voltages DV and the kickback data voltage DV_KB to the data lines DL. For example, the switching part 530 may output the first data voltage to the first data line DL1 during a first duration T1. The switching part 530 may output the first kickback data voltage to the first data line DL1 during the first data kickback duration T_DKB1. The switching part 530 may output the second data voltage to the first data line DL1 during a second duration T2.

According to an exemplary embodiment of the present inventive concept, the second data voltage is charged to the second pixel SP2 by a lesser amount due to the outputting the first kickback data voltage in the first data kickback duration T_DKB1 between the first and second durations T1 and T2. Accordingly, a charging rate of the second pixel SP2 gets closer to a charging rate of the first pixel SP1. In other words, a difference between the charging rate of the first and second pixels SP1 and SP2 can be reduced.

The data voltage generator 510 generates the data voltages DV based on the data signal DAT. For example, the data voltage generator may generate (n−2)-th, (n−1)-th and n-th data voltages. The (n−2)-th data voltage corresponds to the (n−2)-th pixel SPn−2. The (n−1)-th data voltage corresponds to the (n−1)-th pixel SPn−1. The n-th data voltage corresponds to the n-th pixel SPn. The (n−1)-th and n-th data voltages may correspond to the maximum grayscale, and the (n−2)-th data voltage may correspond to the minimum grayscale. In this case, the (n−2)-th through n-th data voltages may be for displaying a cyan color, if the (n−1)-th pixel SPn−1 is a subpixel for displaying a green color and the n-th pixel SPn is a subpixel for displaying a blue color.

The data kickback signal generator 522 generates the data kickback signal DKB_O based on the second data kickback control signal DKB_CONT2. For example, the data kickback signal generator 522 may generate a second data kickback signal having a second data kickback level DKB_L2 during a second data kickback duration T_DKB2. The second data kickback level DKB_L2 may be different from levels of the (n−1)-th and n-th data voltages. For example, the second data kickback level DKB_L2 may be lower than the levels of the (n−1)-th and n-th data voltages. A polarity of the second data kickback signal may be substantially the same as polarities of the (n−1)-th and n-th data voltages.

The first and second pixels SP1 and SP2 may be disposed on the first area A1 of the display panel 100, and the (n−1)-th and n-th pixels SPn−1 and SPn may be disposed on the fourth area A4 of the display panel 100.

In this case, the second data kickback level DKB_L2 may be different from the first data kickback level DKB_L1. For example, the second data kickback level DKB_L2 may be lower than the first data kickback level DKB_L1. In other words, a difference between the second data kickback level DKB_L2 and the levels of the (n−1)-th and n-th data voltages may be greater than a difference between the first data kickback level DKB_L1 and the levels of the first and second data voltages.

In this case, a width of the second data kickback duration T_DKB2 may be different from a width of the first data kickback duration T_DKB1. For example, the width of the second data kickback duration T_DKB2 may be greater than the width of the first data kickback duration T_DKB1.

The switching part 530 processes the data voltages DV and the data kickback signal DKB_O, and generates the kickback data voltage DV_KB. The kickback data voltage DV_KB has the data kickback level DKB_L during the data kickback duration T_DKB. For example, the switching part 530 may combine the (n−1)-th and n-th data voltages and the second data kickback signal, and may generate a second kickback data voltage. The second kickback data voltage may have the second data kickback level DKB_L2 during the second data kickback duration T_DKB2.

The switching part 530 outputs the data voltages DV and the kickback data voltage DV_KB to the data lines DL. For example, the switching part 530 may output the (n−1)-th data voltage to the first data line DL1 during a third duration T3. The switching part 530 may output the second kickback data voltage to the first data line DL1 during the second data kickback duration T_DKB2. The switching part 530 may output the n-th data voltage to the first data line DL1 during a fourth duration T4.

According to an exemplary embodiment of the present inventive concept, the n-th data voltage is charged to the n-th pixel SPn by a lesser amount due to the outputting the second kickback data voltage in the second data kickback duration T_DKB2 between the third and fourth durations T3 and T4. Accordingly, a charging rate of the n-th pixel SPn gets closer to a charging rate of the (n−1)-th pixel SPn−1. In other words, a difference between the charging rate of the n-th and (n−1)-th pixels SPn and SPn−1 can be reduced.

In addition, the width of the data kickback duration and the data kickback level are set differently according to areas of the display panel 100 so that the difference of a resistive capacitive (RC) delay of each area can be reduced. Thus, display quality of the display panel 100 can be increased.

Further, since a kickback data voltage is outputted between consecutive data voltages to a pixel based on input image data and a location of the pixel, a difference of a charging rate between pixels disposed on each area of a display panel 100 can be reduced. Thus, display quality of the display panel 100 can be improved.

The above described exemplary embodiments of the present inventive concept may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A display apparatus, comprising:

a display panel comprising a data line and first and second pixels connected to the data line;

a timing controller configured to generate a data signal and a data kickback control signal in response to input image data; and a data driver configured to generate first and second data voltages in response to the data signal, generate a data kickback signal in response to the data kickback control signal, process the first and second data voltages and the data kickback signal, output the first data voltage to the data line during a first duration, output the second data voltage to the data line during a second duration, and output a first kickback data voltage to the data line during a first data kickback duration, wherein the first data voltage corresponds to the first pixel, the second data voltage corresponds to the second pixel, the first kickback data voltage has a first data kickback level, the first data kickback duration is between the first and second durations.

2. The display apparatus of claim 1, wherein the data kickback signal has the first data kickback level during the first data kickback duration.

3. The display apparatus of claim 2, wherein the data kickback control signal includes first and second data kickback control signals, the first data kickback level is determined in response to the first data kickback control signal, and a width of the first data kickback duration is determined in response to the second data kickback control signal.

4. The display apparatus of claim 3, further comprising:

a gamma reference voltage generator configured to generate gamma reference voltages corresponding to the data signal, wherein the data driver is configured to select one of the gamma reference voltages in response to the first data kickback control signal to determine the first data kickback level.

5. The display apparatus of claim 4, wherein the data driver comprises:

a multiplexer configured to select one of the gamma reference voltages in response to the first data kickback control signal.

6. The display apparatus of claim 1, wherein the data driver is configured to process the first and second data voltages and the data kickback signal by using a switching circuit.

7. The display apparatus of claim 1, wherein the display panel is divided into a plurality of areas, and wherein the first data kickback level and a width of the first data kickback duration are determined according to an area of the display panel on which the first and second pixels are disposed.

8. The display apparatus of claim 7, wherein as an area of the display panel on which the first and second pixels are disposed gets farther away from the data driver, the first data kickback level decreases.

9. The display apparatus of claim 7, wherein as an area of the display panel on which the first and second pixels are disposed gets father away from the data driver, the width of the first data kickback duration increases.

10. The display apparatus of claim 1, wherein the first pixel is configured to display a first color, and wherein the second pixel is configured to display a second color different from the first color.

11. The display apparatus of claim 10, wherein the first and second pixels are included in a unit pixel.

12. The display apparatus of claim 1, wherein the first data kickback level is different from a level of the first data voltage and a level of the second data voltage.

13. The display apparatus of claim 1, wherein a polarity of the first kickback data voltage is substantially the same as a polarity of the first data voltage and a polarity of the second data voltage.

14. A method of driving a display apparatus comprising a display panel, the display panel comprising a data line and first and second pixels connected to the data line, the method comprising:

generating a data signal and a data kickback control signal in response to input image data;

generating first and second data voltages in response to the data signal, wherein the first data voltage corresponds to the first pixel, and the second data voltage corresponds to the second pixel;

generating a data kickback signal in response to the data kickback control signal;

processing the first and second data voltages and the data kickback signal;

outputting the first data voltage to the data line during a first duration;

outputting the second data voltage to the data line during a second duration; and outputting a first kickback data voltage to the data line during a first data kickback duration, wherein the first kickback data voltage has a first data kickback level, and the first data kickback duration is between the first and second durations.

15. The method of claim 14, wherein the data kickback signal has the first data kickback level during the first data kickback duration.

16. The method of claim 15, further comprising:

determining the first data kickback level in response to the data kickback control signal; and determining a width of the first data kickback duration in response to the data kickback control signal.

17. The method of claim 16, wherein determining the first data kickback level comprises:

selecting one of gamma reference voltages in response to the data kickback control signal.

18. The method of claim 14, wherein processing the first and second data voltages and the data kickback signal comprises:

combining the first and second data voltages and the data kickback signal by using a switching circuit.

19. A data driver, comprising:

a data voltage generating circuit configured to generate first and second data voltages in response to a data signal;

a data kickback circuit configured to generate a data kickback signal in response to a data kickback control signal; and a switching circuit configured to generate a kickback data voltage based on the first and second data voltages and the data kickback signal, wherein the kickback data voltage is output between the first and second data voltages.

20. The data driver of claim 19, wherein the first data voltage corresponds to a first pixel of a display panel and the second data voltage corresponds to a second pixel of the display panel, and a level and a duration of the kickback data voltage depend on the location of the first and second pixels in the display panel.

* * * * *